US005145122A

United States Patent [19]

Poister

[11] Patent Number: 5,145,122

[45] Date of Patent: Sep. 8, 1992

[54] FLEXIBLE STRAND OR HOSE CADDY

[76] Inventor: Clarence E. Poister, 1838 S. Laurel, Wichita, Kans. 67207

[21] Appl. No.: 696,373

[22] Filed: May 6, 1991

[51] Int. Cl.[5] ..... B65H 75/24; B65H 54/02

[52] U.S. Cl. ..... 242/85.1; 242/96; 24/71.3; 24/129 R

[58] Field of Search ..... 242/85.1, 96; 24/71.2, 24/71.3, 129 R

[56] References Cited

U.S. PATENT DOCUMENTS

| | | | |
|---|---|---|---|
| 605,607 | 6/1898 | Koch | 242/85.1 |
| 1,365,762 | 1/1921 | Zinow | 242/85.1 |
| 2,423,533 | 7/1947 | Turner | 242/85.1 |
| 2,573,636 | 10/1951 | Wilson | 242/85.1 |
| 2,684,550 | 7/1954 | Reid | 242/85.1 |
| 3,612,426 | 10/1971 | Germock, Jr. | 242/85.1 |
| 3,901,458 | 8/1975 | Kuncz, Jr. | 242/85.1 |
| 4,033,276 | 7/1977 | Barr | 242/85.1 |
| 4,277,035 | 7/1981 | Gaski | 242/85.1 |
| 4,586,675 | 5/1986 | Brown | 242/85.1 |
| 4,934,625 | 6/1990 | Richardson | 242/85.1 |
| 4,991,788 | 2/1991 | Pattison | 242/85.1 |

*Primary Examiner*—Daniel P. Stodola
*Assistant Examiner*—John Q. Nguyen
*Attorney, Agent, or Firm*—Robert K. Rhea

[57] ABSTRACT

A flexible strand holder is formed by an elongated base having a pair of arms projecting laterally from respective end portions of the base. Cooperating arms of each pair of arms project laterally from the base in diverging relation such that a flexible strand wound around the cooperating arms at each side of the base, normally retain the strand thereon when the base is disposed in an upright position, but which allows the strand to unwind by gravity when the base is supported with its longitudinal axis horizontal. When the flexible strand unwinds from the arms at one side of the base the unwinding action continues when the holder is angularly rotated 180° about its longitudinal axis in a direction releasing the cross-over winding of the strand from one side of the holder to the other.

1 Claim, 1 Drawing Sheet

FLEXIBLE STRAND OR HOSE CADDY

BACKGROUND OF THE INVENTION

1. Field of the Invention

This invention relates to a rack or frame for storing flexible strands, such as string, rope, electric cords or garden hose thereon in such a manner that the strand is self-regulating in unwinding from the holder or rack when a length thereof or the entire strand is needed.

Flexible strands, such as electric cords supplying electrical energy to implements of relatively low amperage and connected with a common outlet source, are usually of greater length than is necessary. These cords are usually in an entangled or unsightly arrangement which is sometimes dangerous to the movement of a workman or other person using some of the implements.

It is therefore desirable to provide a holder or frame-like device on which excess lengths of cord may be wound and maintained in an out-of-way position and from which the cord or strand may be easily unwound if needed. This invention provides such devices.

2. Description of the Prior Art

There are presently available on the common market a plurality of various types of cord winders or holders, most of which feature U or Y-shaped end portions that maintain the flexible strands or cords in place.

The cords or strands are usually manually wound in a clockwise direction over the ends of the U or Y-shaped holder a number of turns then looped and wound counter-clockwise to eliminate twisting or kinking of cords and must be manually unwound for use.

The most pertinent prior patent is believed to be U.S. Pat. No: 3,901,458. This patent discloses a planar base around which a length of cord is manually wound between laterally converging edge surfaces. These diverging surfaces are provided with a pair of pivotally connected lobes or lugs at opposite ends of one side thereof and in the cord wind-up position these lugs extend in opposite directions with respect to each other. When the cord is to be unwound, the two lugs are pivoted toward each other to extend parallel from the side of the base inline with the respective converging edge on which the strand has been wound so that the cord may fall or be pulled therefrom in a cord unwinding action.

This invention is distinctive over this and prior cord winding devices presently in use by providing a cord supporting frame having spaced apart arm-like members diverging laterally outward from respective end portions of a central elongated base in a manner for receiving the cord in a wound-up fashion and released therefrom by gravity when the elongated base is supported in a horizontal position or the cord is manually pulled off cooperating arms.

SUMMARY OF THE INVENTION

A strand holding frame is formed by an elongated base member having a pair of arms secured to the respective end portions of the base.

The arms of each pair of arms project laterally outward from the base in aligned relation with the end portions of the arm opposite the base diverging outwardly on predetermined angles.

A flexible strand manually wound around cooperating arms of the pairs of arms maintains the strand thereon and permits a gravity unwinding of the strand when the base is held with its longitudinal axis parallel with the surface of the earth.

The principal object of the invention is to provide a rack or holder for winding and storing an elongated flexible strand or an intermediate portion thereof in a manner permitting the flexible strand to be released therefrom by supporting the holder with its central longitudinal axis horizontal and allowing the strand to progressively fall by gravity from the holder in an unwinding action.

DESCRIPTION OF THE PREFERRED EMBODIMENTS

Figure 1:
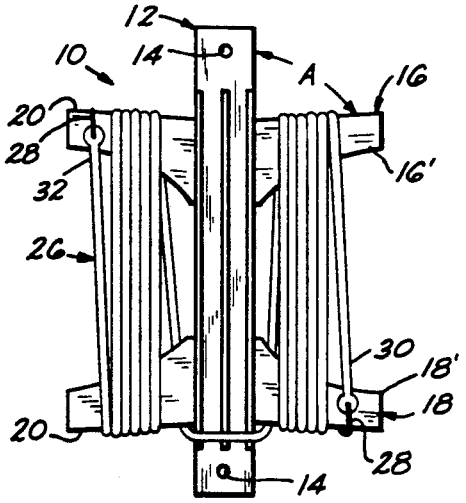
FIG. 1 is an elevational view of a flexible strand holder having a flexible strand wound thereon.

Like characters of reference designate like parts in those figures of the drawings in which they occur.

Figure 3:
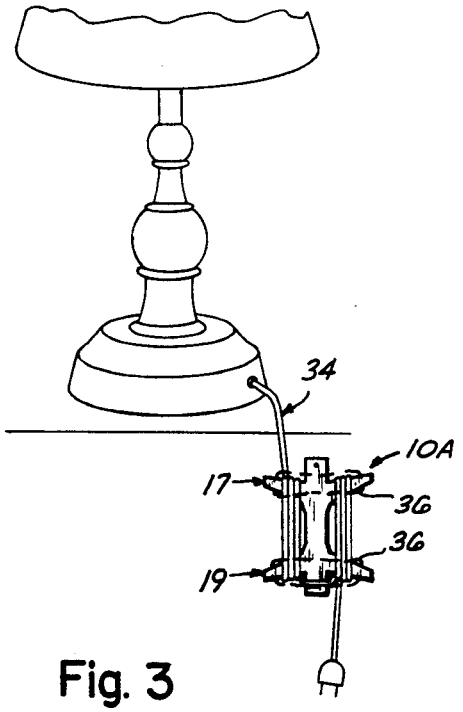
FIG. 3 is an elevational view of an intermediate portion of an electric cord wound on a strand holder with the cord connected with a fragment of an electric lamp.
Figure 4:
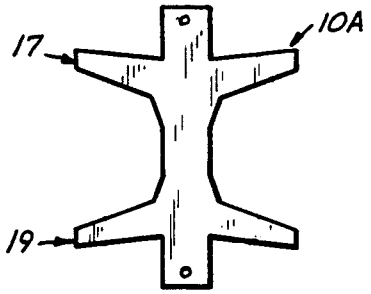
FIG. 4 is an elevational view, to a different scale, of the cord/strand holder of FIG. 3, per se.

In the drawings:

Referring first to FIGS. 1, 3 and 4, the reference numeral 10 indicates a strand holding frame formed by an elongated planar base member 12 having an aperture 14 in its respective end portions for hanging the frame 10 on a nail or the like when not in use or for storage of a flexible strand wound thereon.

The frame 10 further includes two pairs of arms 16 and 18 with each arm of each pair of arms integrally projecting laterally of the respective end portion of the base in aligned relation. The cord supporting edge 20 of each arm of said pairs of arms is disposed in spaced relation with the respective terminal end of the base 12 to form a handle portion at each end of the base.

The edge surface 20 of each arm of each pair of arms is disposed at an angle A with respect to the longitudinal axis of the base 12 ranging from approximately 80° to 87° in accordance with the strand material being wound thereon and for the purposes believed presently apparent.

As viewed in FIG. 1 an elongated length of flexible resilient load binding cord material 26 having a metal hook 28 at its one end portion 30 is wound on the frame 10 as by attaching one of its hooks 28 to one arm edge 20 of the pair of arms 18 and while holding the frame with its base portion upright by manually grasping the upper end handle portion of the base, the cord or strand 26 is manually wound in a clockwise direction around the respective arms projecting laterally, to the right as viewed in FIG. 1, of the pairs of arms 16' and 18'. Substantially one-half or a selected portion of the strand 26 is wound on these two arms. The edge surfaces 20 are preferably arcuately curved transversely to minimize strand damage.

The frame is then manually rotated about its longitudinal axis and an intermediate portion of the strand 26 is extended across the depending end portion of the frame base to continue the winding of the remaining portion on the strand around the other arms of the respective pair of arms 16 and 18 opposite the arms 16' and 18'.

The other end portion 32 of the strand is fastened by engaging its hook 28 over the edge of the upper left arm, as viewed in FIG. 1. This positions the flexible strand 26 in a wound up position on the frame 10 whereby it may be stored, as by hanging the frame 10 from a suitable support or transported in a vehicle for use when desired.

Referring to FIG. 3, the one piece frame 10A is shown on a reduced scale, with respect to the frame shown by FIG. 1. A lamp electrical cord 34 has an intermediate portion of its length similarly wound on the frame 10A.

In this example, the cord 34 is maintained on the frame by a ring-like resilient member, such as a rubber band, indicated by the broken lines 36, having opposing loop end portions of the rubber band 36 enveloping end portions of the pairs of arms 17 and 19 projecting laterally beyond the wound up electrical cord to prevent unauthorized unwinding action of the electrical cord off the frame 10A.

Figure 2:
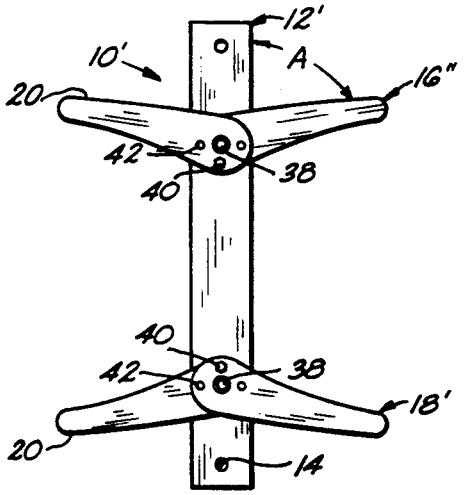
FIG. 2 is an elevational view of another embodiment of the strand holder.

Referring now to FIG. 2, the frame 10' has the arms of its planar pairs of arms 16'' and 18'' formed separately from the frame base 12'. The respective pair of arms 16'' and 18'' are pivotally connected in overlapping relation, with respect to each other and the frame base, by a central pivot pin 38 for vertical pivoting movement of the respective arm of the pairs of arms 16'' and 18'' as viewed in FIG. 2.

The frame base 12' and the respective attached end portion of each arm of the pairs of arms 16'' and 18'' are further line drilled on equal radii radially spaced from the pivot pin 38 for receiving an arm positioning pin 40 maintaining the edge surface 20 of the respective arm of said pairs of arms 16'' and 18'' defining a desired angle A with respect to the longitudinal axis of the frame base 12'. This permits adjusting the respective arms of the pairs of arms relative to the base and enlarging or reducing the angle A between the arm edges 20 and the adjacent edge of the frame base 12' by simply removing the pins 40 and adjusting arms of each pair of arms as desired and reinserting the pin 40 into one of the other cooperating holes 42.

Figure 5:
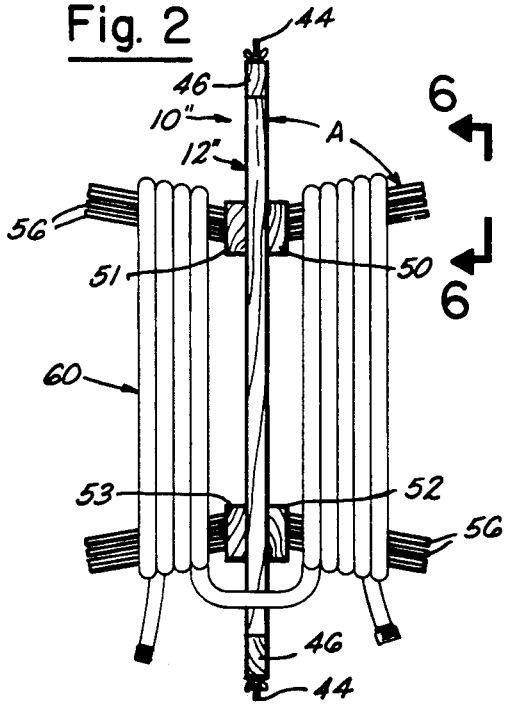
FIG. 5 is an elevational view of another embodiment of the strand holder having a length of garden hose wound thereon; and, FIG. 6 is a fragmentary end view of one hose supporting arm member of FIG. 5, looking in the direction of the line 6—6.
Figure 6:
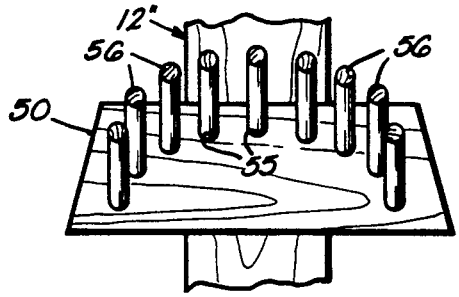

Referring now more particularly to FIGS. 5 and 6, the frame 10'' similarly comprises an elongated base member 12'' having axle means formed by a pair of pins or bolts 44 axially projecting from its respective ends which are cooperatively received in vertically aligned apertures formed in the respective end portions of a pair of beams 46, shown in end view (FIG. 5). The other end portions of the beams projecting horizontally outward in vertically spaced parallel relation in cantilever fashion from a suitable standard, such as a fence post or a building wall, neither being shown.

The pins 44 thus permit the frame base 12'' to be manually rotated angularly about the vertical axis formed by the frame 12'' and its pins 44 for the purpose presently believed obvious.

In this embodiment a pair of arm bases 50–51 are horizontally connected on opposing sides of the frame base 12'' adjacent one end thereof and similarly a second pair of arm bases 52–53 are mounted adjacent the depending end portion of the frame base 12', as viewed in FIG. 5.

Each of the arm end bases are provided with a circular array of apertures or sockets 55 for receiving one end portion of a plurality of dowel rods 56, or the like, of selected length for forming upper and lower pairs of strand receiving arms 57 and 58 and presenting a convex surface facing toward the respective end of the base over which intermediate portions of a diametrically greater flexible strand, such as a garden hose 60, may be wound in the manner described hereinabove for the resilient strand 26 or electric cord 34.

OPERATION

In the operation of either of the strand supporting frames 10 or 10' when it is desired to remove all or a portion of the flexible strand 26 from the frame 10, or 10' one end of the flexible strand is removed from contact with the frame arm and the frame base 12 is manually held horizontally so that the free end portion of the just released flexible resilient strand may fall by gravity off the surfaces 20 of the downwardly disposed pair of arms. This self unwinding action continues until that half or portion of the flexible strand has been removed from the downwardly directed arms of the pair of arms 16 and 18. To continue the self releasing of the strand 26 the frame 10 or 10' is manually rotated 180° about its longitudinal axis in a cooperative unwinding action of the strand cross-over winding of the strand from one side of the holder to the other, which, by remaining horizontal, allows the remaining portion of the strand to continue falling by gravity off the other arms of the pairs of arms 16 and 18.

Releasing the electric cord 34 from the smaller version of the frame 10A is identical to that described hereinabove for FIG. 1, however, the resilient endless band 36 must be released from its confining relation with respect to the electric cord before the unwinding action can begin.

In the frame version 10'', when it is desired to remove the hose 60 from the pairs of arms 57 and 58 one end of the hose is manually grasped and by the operator walking in a direction away from the mounted frame, the hose is simply pulled off the end portions of the rods 56 of the respective pairs of arms 57 and 58 projecting toward the operator until that portion of the wound up hose is released from these arm end portions. Continued tension on the hose pivots the frame 10'' about its vertical axis, thus permitting the remaining hose to be similarly released from the other arms of the pairs of arms 57 and 58.

Obviously the invention is susceptible to changes or alterations without defeating its practicability. Therefore, I do not wish to be confined to the preferred embodiment shown in the drawings and described herein.

I claim:

1. A holder for winding an elongated flexible strand thereon, comprising:

an elongated base having first and second planar surfaces and having parallel side and end edge surfaces and parallel first and second end portions;

a first pair of elongated planar arm, each arm of said first pair of arms having arcuately curved end edge surfaces characterized by one arcuate end edge surface being diametrically greater than the other arcuate end edge surface for defining part-circular arm end portions on each arm of said first pair of arms and opposing arm side edge surfaces converging from the diametrically greater part-circular end edge surface, the diametrically greater part-circular end portion of each arm of said first pair of arms disposed in overlapping relation, one upon the other, on and extending transversely from respective side edges of said base adjacent but spaced from one end thereof, said first end portion of said base and the central portion of the diametrically greater part-circular end portion of each arm of said first pair of arms having cooperatively aligned first pivot pin receiving apertures therethrough and having a plurality of circumferentially spaced first arm position pin receiving apertures therethrough equally spaced radially with respect to the first pivot pin receiving apertures;

a first pivot pin in the first pivot pin apertures;

an arm positioning pin in selected first position pin apertures for disposing one side edge surface of said converging side edge surfaces of each arm of said first pair of arms on an angle of not less than 80° and not more than 87° with respect to the adjacent side edge surface of said base adjacent said first end portion;

a second pair of elongated planar arms, each arm of said second pair of arms having arcuately curved end edge surfaces characterized by one arcuate end edge surface being diametrically greater than the other arcuate end edge surface for defining part-circular arm end portions on each arm of said second pair of arms and opposing arm side edge surfaces converging from the diametrically greater part-circular end edge surface, the diametrically greater part-circular end portion of each arm of said second pair of arms disposed in overlapping relation, one upon the other, on and extending transversely from respective side edges of said base adjacent but spaced from the other end thereof, said second end portion of said base and the central portion of the diametrically greater part-circular end portion of each arm of said second pair of arms having cooperatively aligned second pivot pin receiving apertures therethrough and having a plurality of circumferentially spaced second arm position pin receiving apertures therethrough equally spaced radially with respect to the second pivot pin receiving apertures;

a second pivot pin in the second pivot pin apertures; and, an arm positioning pin in selected second position pin apertures for disposing one side edge surface of said converging side edge surfaces of each arm of said second pair of arms on an angle of not less than 180° and not more than 87° with respect to the adjacent side edge surface of said base adjacent said second end portion, whereby a free end portion of a flexible strand when wound around one arm of said first pair of arms and a cooperating arm of said second pair of arms falls by gravity off the last said arms in a flexible strand unwinding action when the longitudinal axis of said base is disposed horizontally and said last arms are vertically disposed downward.

* * * * *